US012747546B2

(12) United States Patent
Li et al.

(10) Patent No.: US 12,747,546 B2
(45) Date of Patent: Sep. 29, 2026

(54) METHOD AND DEVICE FOR DETECTING DEFLECTION BASIN BASED ON DEFORMATION SPEED UNDER ROLLING LOAD

(71) Applicant: WUHAN OPTICS VALLEY ZOYON SCI AND TECH CO., LTD., Hubei (CN)

(72) Inventors: Qingquan Li, Hubei (CN); Hong Lin, Hubei (CN); Min Cao, Hubei (CN); Xinlin Wang, Hubei (CN); Huihong Zhou, Hubei (CN); Shishi Wei, Hubei (CN)

(73) Assignee: WUHAN OPTICS VALLEY ZOYON SCI AND TECH CO., LTD., Hubei (CN)

( * ) Notice: Subject to any disclaimer, the term of this patent is extended or adjusted under 35 U.S.C. 154(b) by 255 days.

(21) Appl. No.: 18/724,542

(22) PCT Filed: Sep. 14, 2022

(86) PCT No.: PCT/CN2022/118738
§ 371 (c)(1),
(2) Date: Jun. 26, 2024

(87) PCT Pub. No.: WO2024/011746
PCT Pub. Date: Jan. 18, 2024

(65) Prior Publication Data

US 2025/0101693 A1 Mar. 27, 2025

(30) Foreign Application Priority Data

Jul. 11, 2022 (CN) ..... 202210814910.8

(51) Int. Cl.
*E01C 23/01* (2006.01)

(52) U.S. Cl.
CPC ..... *E01C 23/01* (2013.01)

(58) Field of Classification Search
CPC ..... E01C 23/01
See application file for complete search history.

(56) References Cited

U.S. PATENT DOCUMENTS 12,270,729 B2 * 4/2025 Cao ..... G01M 5/00
2013/0283924 A1 * 10/2013 McCullough ..... G01N 3/00 250/461.1

(Continued)

FOREIGN PATENT DOCUMENTS

CN 101205700 A 6/2008
CN 101831862 A 9/2010

(Continued)

OTHER PUBLICATIONS

International Search Report and Written Opinion for International Application No. PCT/CN2022/118738 mailed Nov. 7, 2022.

(Continued)

*Primary Examiner* — Eric S. McCall
(74) *Attorney, Agent, or Firm* — Ballard Spahr LLP

(57) ABSTRACT

A method for detecting a deflection basin based on a deformation velocity of a pavement under a rolling load is provided. The method includes: obtaining vertical deformation velocities of the pavement at respective measurement timings corresponding to respective target locations in a target deflection basin during the load movement; obtaining durations for respective response time intervals corresponding to the respective target locations based on the respective measurement timings, the vertical deformation velocities of the pavement at the respective measurement timings and a knowledge base model; obtaining representative vertical deformation velocities of the pavement based on the vertical deformation velocities of the pavement, the durations for respective response time intervals, and the knowledge base (Continued)

model for the vertical deformation velocities of the pavement; and obtaining detection results of the target deflection basin based on the representative vertical deformation velocities of the pavement and the durations for respective response time intervals.

10 Claims, 3 Drawing Sheets

(56) References Cited

U.S. PATENT DOCUMENTS

| | | | | |
|---|---|---|---|---|
| 2019/0197340 | A1* | 6/2019 | Li | G06T 7/521 |
| 2022/0017126 | A1* | 1/2022 | Cao | G01N 3/32 |
| 2025/0086777 | A1* | 3/2025 | Lin | G06T 7/13 |

FOREIGN PATENT DOCUMENTS

| | | | |
|---|---|---|---|
| CN | 102162217 | A | 8/2011 |
| CN | 102444079 | A | 5/2012 |
| CN | 102535317 | A | 7/2012 |
| CN | 103334369 | A | 10/2013 |
| CN | 103452032 | A | 12/2013 |
| CN | 103643621 | A | 3/2014 |
| CN | 103669183 | A | 3/2014 |
| CN | 107012772 | A | 8/2017 |
| CN | 107119543 | A | 9/2017 |
| CN | 109614674 | A | 4/2019 |
| CN | 109724884 | A | 5/2019 |
| CN | 209741809 | U | 12/2019 |
| CN | 111444463 | A | 7/2020 |
| CN | 114049294 | A | 2/2022 |
| WO | 9631655 | A1 | 10/1996 |
| WO | 2013163618 | A1 | 10/2013 |
| WO | 2013185759 | A1 | 12/2013 |
| WO | 2019000261 | A1 | 1/2019 |
| WO | 2020147180 | A1 | 7/2020 |

OTHER PUBLICATIONS

"Key technologies and engineering applications for ultra-high precision automated intelligent detection of transportation infrastructure", Jan. 6, 2022, 2 pages.

"Research on the calculation model of rapid detection of road deflection based on laser Doppler technology", Oct. 2016, pp. 7-9.

Jingsong , et al., "Road Surface Deflection Analysis Under Moving Load", Journal of Southeast University, vol. 37, No. 1, Jan. 2007, pp. 107-112.

Wang , "Key Technologies and Equipment for Road Pavement Dynamic Detection", Feb. 2016, p. 46.

Xu, et al., "Analysis on Asphalt Concrete Pavement Deformation Characteristics Time-Domain Considering Vehicle-Pavement Coupling Effect", Journal of Highway and Transportation Research and Development, vol. 34, No. 12. DOI: 10.3969/j.issn.1002-0268.2017.12.003, Dec. 3, 2017, pp. 16-34.

Zhang , et al., "Deflection Measurement Methods Based on Velocities of Pavement Deflections", Journal of Shanghai Jioa Tong University, vol. 49, No. 2. DOI: 10.16183/j.cnki.jsjtu.2015.02.014, Feb. 14, 2015, pp. 220-231.

* cited by examiner

METHOD AND DEVICE FOR DETECTING DEFLECTION BASIN BASED ON DEFORMATION SPEED UNDER ROLLING LOAD

CROSS-REFERENCE TO RELATED APPLICATION

The present application is a National Stage of International Application No. PCT/CN2022/118738, filed on Sep. 14, 2022, which claims priority to Chinese Patent Application No. 202210814910.8, filed on Jul. 11, 2022, entitled "Method and Device for Detecting Deflection Basin based on Deformation Speed under Rolling Load", which are hereby incorporated by reference in their entireties.

FIELD

The present application relates to the field of highway pavement and airport pavement detection technologies, in particular to a method and an apparatus for detecting a deflection basin based on deformation velocity under a rolling load.

BACKGROUND

Detecting a deflection of a highway pavement/airport pavement is a basis for evaluating the bearing capacity of the pavement, and it is very important for the control and inspection of engineering quality. Traditional deflection measurement methods are based on direct methods for displacement measurement, that is, directly measuring a displacement of the pavement under the force and include a Beckman crossbeam and a falling weight deflectometer (FWD). However, these deflection measurement methods are low in measurement efficiency, have great impact on traffic and huge safety hazards since they are all measurement methods by using dynamic driving in combination with static measurement and cannot meet requirements of measuring dynamic deflection of a road network in a short period required for preventive maintenance of roads.

Currently, under normal traffic speed, there are mainly two types of rapid deflection measurement methods: direct measurement methods using "force-displacement" and indirect measurement methods using "force-speed-deformation".

The direct measurement methods using "force-displacement" include a rolling wheel deflectometer (RWD), a road deflection tester (RDT), a rolling dynamic deflectometer (RDD), etc. Although these measurement methods have achieved certain results during an experimental stage, they have not been applied in actual engineering.

The indirect measurement methods using "force-speed-deformation", that is, deflection measurement based on a deformation velocity of a pavement, include a traffic speed deflectometer (TSD), a high speed deflectograph (HSD), a laser dynamic deflectometer (LDD), etc. A measurement system using the indirect measurement methods consists of a plurality of Doppler vibrometers, one of which is used to measure data with no vertical deformation velocity of a pavement outside a deflection basin (for example, at 3.6 meters) for reference, and the rest of which are used to measure the vertical deformation velocities of the pavement in the deflection basin under the 50 KN load wheel. This type of system can normally measure a maximum deflection value at a load center of an actual road network at 20-90 km/h.

Although the bearing performance of a structural layer can be reflected by the maximum deflection value at the load center, the bearing performance of a certain structural layer cannot be characterized, and deflections at load centers with similar bearing capacity may be very different. The deflection of a single point on a road surface cannot reflect the actual bearing capacity of the pavement structure well, and it is obviously irrational to use it for pavement reinforcement design or maintenance decision-making. To accurately evaluate the bearing capacity of the pavement structure, it is necessary to use the data of the pavement deflection basin to determine the modulus of each structural layer of the pavement, and carry out the stress analysis of the pavement structure to obtain a change law of the bearing capacity, and then use the to evaluate a construction quality and usage status of the road.

The deflection of a highway pavement/airport pavement is usually detected by detecting the deflection of the deflection of a single point on a road surface and rapidly detecting a deflection basin of the highway pavement/airport pavement is a problem to be solved urgently in the field.

SUMMARY

The present application provides a method and an apparatus for detecting a deflection basin based on deformation velocity under a rolling load, which solves the defect of difficulty in rapidly detecting the deflection basin and provides continuous and rapid detection of the deflection basin.

The present application provides a method for detecting a deflection basin based on a deformation velocity of a pavement under a rolling load, including:

obtaining vertical deformation velocities of the pavement at respective measurement timings corresponding to respective target locations in a target deflection basin during the load movement;

obtaining durations for respective response time intervals corresponding to the respective target locations based on the respective measurement timings corresponding to the respective target locations, the vertical deformation velocities of the pavement at the respective measurement timings corresponding to the respective target locations and a knowledge base model for the vertical deformation velocities of the pavement;

obtaining representative vertical deformation velocities of the pavement at the respective response time intervals corresponding to the respective target locations based on the vertical deformation velocities of the pavement at the respective measurement timings corresponding to the respective target locations, the durations for respective response time intervals corresponding to the respective target locations, and the knowledge base model for the vertical deformation velocities of the pavement; and obtaining detection results of the target deflection basin based on the representative vertical deformation velocities of the pavement at the respective response time intervals corresponding to the respective target locations and the durations for respective response time intervals corresponding to the respective target locations, where the respective target locations include a first measurement point and at least three second measurement points, the first measurement point is a location in the target deflection basin where a measurement point corresponding to a central location of a load is located, the second measurement points are locations where measurement points in the target deflection basin except the central location of the load are located; and each of the respective measurement timings corresponding to respective target locations is calculated from a speed of load movement and a horizontal installation location of a velocimeter in a system for detecting a deflection basin.

The method for detecting the deflection basin based on the deformation velocity under the rolling load according to the present application is suitable for detecting a deflection basin in highway pavement or airport pavement;

after obtaining the detection results of the target deflection basin based on the representative vertical deformation velocities of the pavement at the respective response time intervals corresponding to the respective target locations and the durations for respective response time intervals corresponding to the respective target locations, the method further includes:

correcting the detection results of the target deflection basin based on measurement environment information of the target deflection basin and a knowledge base model for correction of deflection basin.

In the method for detecting the deflection basin based on the deformation velocity under the rolling load according to the present application, the obtaining durations for respective response time intervals corresponding to the respective target locations based on the respective measurement timings corresponding to the respective target locations, the vertical deformation velocities of the pavement at the respective measurement timings corresponding to the respective target locations and a knowledge base model for the vertical deformation velocities of the pavement, includes:

obtaining respective first durations based on the respective measurement timings corresponding to the respective target locations, where each of the respective first durations is a time difference between two adjacent measurement timings corresponding to any of the target locations;

obtaining a response start time and a response end time of the first measurement point under the load based on the respective first durations, vertical deformation velocities of the pavement at respective measurement timings corresponding to the first measurement point and the knowledge base model for the vertical deformation velocities of the pavement;

obtaining durations for respective response time intervals corresponding to the first measurement point based on respective measurement timings corresponding to the first measurement point and the response start time and the response end time of the first measurement point under the load;

obtaining response start times of the second measurement points under the load based on the respective first durations, vertical deformation velocities of the pavement at respective measurement timings corresponding to the second measurement points and the knowledge base model for the vertical deformation velocities of the pavement; and obtaining durations for respective response time intervals corresponding to the second measurement points based on respective measurement timings corresponding to the second measurement points and the response start times of the second measurement points under the load.

In the method for detecting the deflection basin based on the deformation velocity under the rolling load according to the present application, the obtaining detection results of the target deflection basin based on the representative vertical deformation velocities of the pavement at the respective response time intervals corresponding to the respective target locations and the durations for respective response time intervals corresponding to the respective target locations, includes:

obtaining accumulative vertical deformation amount corresponding to each target location based on the representative vertical deformation velocities of the pavement at respective response time intervals corresponding to each target location and durations for the respective response time intervals; and determining the accumulative vertical deformation amount of each of the respective target locations as a detection result of each target deflection, where the obtaining accumulative vertical deformation amount corresponding to each target location based on the representative vertical deformation velocities of the pavement at respective response time intervals corresponding to each target location and durations for the respective response time intervals, includes:

obtaining each product of representative pavement vertical deformation velocity at each response time interval corresponding to the target location and a duration for each response time interval; and determining a sum of all products as the accumulative vertical deformation amount corresponding to each target location.

In the method for detecting the deflection basin based on the deformation velocity under the rolling load according to the present application, the obtaining representative vertical deformation velocities of the pavement at the respective response time intervals corresponding to the respective target locations based on the vertical deformation velocities of the pavement at the respective measurement timings corresponding to the respective target locations, the durations for respective response time intervals corresponding to the respective target locations, and the knowledge base model for the vertical deformation velocities of the pavement, includes:

for each target location among the target locations, obtaining representative vertical deformation velocities of the pavement at the respective response time intervals corresponding to the target location based on vertical deformation velocities of the pavement at different measurement timings corresponding to the target location, the durations for respective response time intervals corresponding to the target locations, and the knowledge base model for the vertical deformation velocities of the pavement.

In the method for detecting the deflection basin based on the deformation velocity under the rolling load according to the present application, the detection results of the target deflection basin include accumulative vertical deformation amount corresponding to the respective target locations.

The correcting the detection results of the target deflection basin based on measurement environment information of the target deflection basin and a knowledge base model for correction of deflection basin, includes:

obtaining correction coefficients for each target location based on the measurement environment information of the target deflection basin and the knowledge base model for correction of deflection basin; and for each target location, correcting the accumulative vertical deformation amount for the target location based on the correction coefficient for each target location.

In the method for detecting the deflection basin based on the deformation velocity under the rolling load according to the present application, the obtaining the response start time and the response end time of the first measurement point under the load based on the respective first durations, vertical deformation velocities of the pavement at respective measurement timings corresponding to the first measurement point and the knowledge base model for the vertical deformation velocities of the pavement, includes:

obtaining the response start time of the first measurement point under the load based on the respective first durations, vertical deformation velocities of the pavement at a plurality of measurement timings corresponding to the first measurement point and being close to the response start time of the first measurement point under the load and the knowledge base model for the vertical deformation velocities of the pavement; and obtaining the response end time of the first measurement point under the load based on the respective first durations, vertical deformation velocities of the pavement at a plurality of measurement timings corresponding to the first measurement point and being close to the response end time of the first measurement point under the load, the knowledge base model for the vertical deformation velocities of the pavement, information on a moving position of the load and movement velocity information of the load.

In the method for detecting the deflection basin based on the deformation velocity under the rolling load according to the present application, the obtaining the response start time of the first measurement point under the load includes:

obtaining a first rate of change of vertical deformation velocities of the pavement based on the respective first durations and the vertical deformation velocities of the pavement at the plurality of measurement timings corresponding to the first measurement point and being close to the response start time of the first measurement point under the load;

obtaining the response start time of the first measurement point under the load based on the first rate of change and the knowledge base model for the vertical deformation velocities of the pavement, where the obtaining response start times of the second measurement points under the load includes:

obtaining a second rate of change of vertical deformation velocity of the pavement based on the respective first durations and the vertical deformation velocities of the pavement at one or more measurement timings corresponding to each of the second measurement points and being close to the response start time of the second measurement points under the load;

obtaining the response start times of the second measurement points under the load based on the second rate of change and the knowledge base model for the vertical deformation velocities of the pavement, where the obtaining the response end time of the first measurement point under the load includes:

obtaining a first rate of change of vertical deformation velocities of the pavement based on the respective first durations and the vertical deformation velocities of the pavement at the plurality of measurement timings corresponding to the first measurement point and being close to the response end time of the first measurement point under the load; and obtaining the response end time of the first measurement point under the load based on the first rate of change and the knowledge base model for the vertical deformation velocities of the pavement.

The present application provides an apparatus for detecting a deflection basin based on a deformation velocity of a pavement under a rolling load, including:

an original velocity obtaining device, used to obtain vertical deformation velocities of the pavement at respective measurement timings corresponding to respective target locations in a target deflection basin during the load movement;

a duration obtaining device, used to obtain durations for respective response time intervals corresponding to the respective target locations based on the respective measurement timings corresponding to the respective target locations, the vertical deformation velocities of the pavement at the respective measurement timings corresponding to the respective target locations and a knowledge base model for the vertical deformation velocities of the pavement;

a representative speed obtaining device, used to obtain representative vertical deformation velocities of the pavement at the respective response time intervals corresponding to the respective target locations based on the vertical deformation velocities of the pavement at the respective measurement timings corresponding to the respective target locations, the durations for respective response time intervals corresponding to the respective target locations, and the knowledge base model for the vertical deformation velocities of the pavement; and a deflection basin detecting device, used to obtain detection results of the target deflection basin based on the representative vertical deformation velocities of the pavement at the respective response time intervals corresponding to the respective target locations and the durations for respective response time intervals corresponding to the respective target locations, where the respective target locations include a first measurement point and at least three second measurement points, the first measurement point is a location in the target deflection basin where a measurement point corresponding to a central location of a load is located, the second measurement points are locations where measurement points in the target deflection basin except the central location of the load are located; and each of the respective measurement timings corresponding to respective target locations is calculated from a speed of load movement and a horizontal installation location of a velocimeter in a system for detecting a deflection basin.

The present application provides a system for detecting a deflection basin based on a deformation velocity of a pavement under a rolling load, including:

a continuous deflection velocity measurement subsystem, and any of apparatuses for detecting the deflection basin based on deformation velocity of the pavement under the rolling load mentioned above, where the continuous deflection velocity measurement subsystem includes a towing device and a carrier, where the carrier is used to move, under control of the towing device, on the pavement and apply load to the pavement during the movement; and a crossbeam is provided on the carrier, and a velocity measurement unit, an attitude measurement unit and an auxiliary measurement unit are provided on the crossbeam, wherein the velocity measurement unit includes a second velocity measurement sensor and at least three first velocity measurement sensors in which each of the first velocity measurement sensors is used to measure the vertical deformation velocities of the pavement in the target deflection basin, the second velocity measurement sensor is installed outside the deflection basin and is used to eliminate velocity noise included in the measurement of the first velocity measurement sensor in the deflection basin;

the attitude measurement unit is used to measure an attitude angular velocity of the crossbeam; and the auxiliary measurement unit includes a positioning subunit used to obtain a position of the load and a traveling speed of the carrier on the pavement.

In the method and the apparatus for detecting the deflection basin based on deformation velocity under the rolling load, the rapid detection of the continuous deflection basin is performed by detecting the deflection basin based on the vertical deformation velocities of the pavement under the rolling load and the problems of low detection efficiency, strong subjectivity, high risk and wasting time and energy in the traditional detection of the deflection basin can be solved. The efficiency and safety in detection of the deflection basin can be improved and deflection values of the entire deflection basin can be obtained, which can solve the problem of inability to characterize the load bearing performance of a certain structural layer since traditional laser dynamic deflectometer system can only measure the maximum deflection value at the center of the load. Detection results of the deflection basin are less affected by the environment and not affected by the texture of the pavement and thus the detection results have higher accuracy.

BRIEF DESCRIPTION OF DRAWINGS

In order to illustrate solutions of embodiments according to the present application or the related art more clearly, the accompanying drawings used in the description of the embodiments or the related art are briefly introduced below. It should be noted that the drawings in the following description are only some embodiments of the present application. For those of ordinary skill in the art, other drawings can be obtained according to these drawings without creative effort.

DETAILED DESCRIPTION OF THE EMBODIMENTS

In order to illustrate purposes, solutions and advantages of the present application more clearly, solutions according to the present application are clearly described below in combination with the accompanying drawings in the present application. It should be noted that the described embodiments are some embodiments of the present application, rather than all the embodiments. Based on the embodiments of the present application, all other embodiments obtained by those of ordinary skill in the art without creative effort are within the scope of protection of the present application.

In the description of the embodiments of the present application, the terms "first", "second", and "third" are used for description only, and cannot be understood as indicating or implying relative importance, and do not involve order.

The method and apparatus for detecting a deflection basin based on deformation velocities of a pavement under a rolling load according to the present application will be described below with reference to FIGS. 1 to 4.

Figure 1:
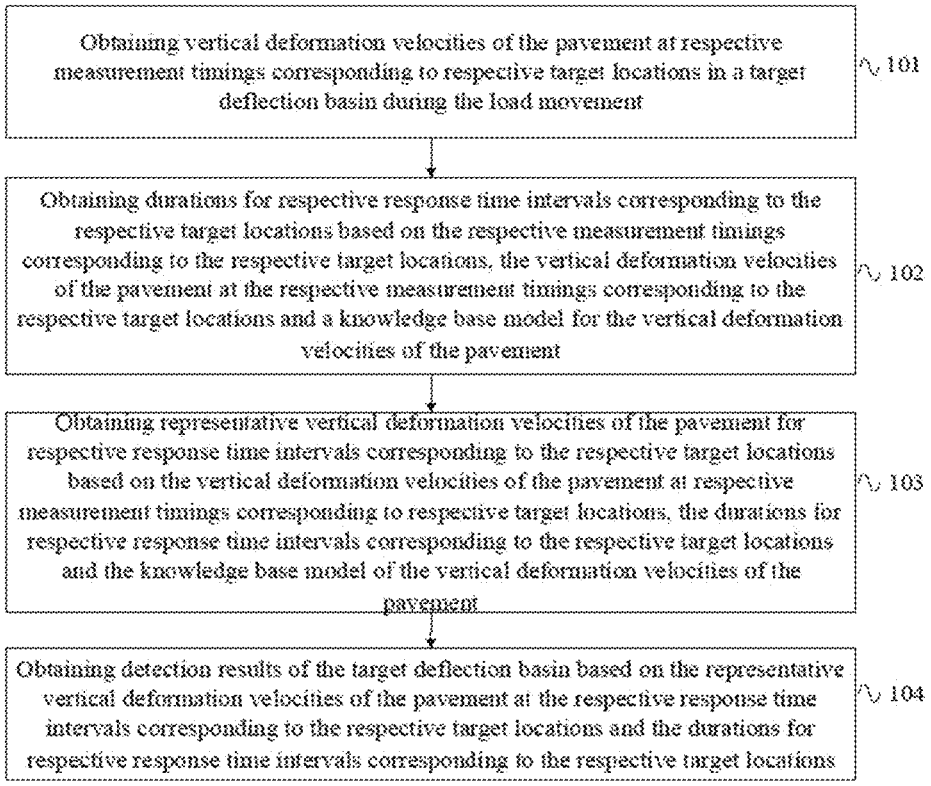
FIG. 1 is a first schematic flow chart of a method for detecting a deflection basin based on deformation velocities of a pavement under a rolling load according to the present application.

FIG. 1 is a first schematic flow chart of a method for detecting a deflection basin based on deformation velocities of a pavement under a rolling load according to the present application. As shown in FIG. 1, the method for detecting the deflection basin can be performed by an apparatus for detecting a deflection basin. The method includes steps 101, 102, 103 and 104.

In the step 101, vertical deformation velocities of the pavement at respective measurement timings corresponding to respective target locations in a target deflection basin during the load movement are obtained. The respective target locations include a first measurement point and at least three second measurement points. The first measurement point is a location in the target deflection basin where a measurement point corresponding to a central location of a load is located. The second measurement points are locations where measurement points in the target deflection basin except the central location of the load are located. Each of the respective measurement timings corresponding to respective target locations is calculated from a speed of load movement and a horizontal installation location of a velocimeter in a system for detecting a deflection basin.

In an embodiment, the obtaining the vertical deformation velocities of the pavement at respective measurement timings corresponding to respective target locations in a target deflection basin during the load movement can be performed based on a continuous deflection velocity measurement subsystem.

In an embodiment, the continuous deflection velocity measurement subsystem can include a towing device and a carrier.

Exemplarily, the towing device may be a machine with towing capacity such as a towing truck.

The carrier is used to move, under control of the towing device, on the pavement and apply load to the pavement during the movement.

In an embodiment, the carrier may be a movable unpowered machine such as a trailer.

In an embodiment, the rear axle of the trailer can apply a load of at least ten tons. The carrier can move, under control of the towing device, on the pavement and apply the load to the pavement during the movement, form a rolling load to act on the pavement.

A crossbeam is provided on the carrier, and a velocity measurement unit, an attitude measurement unit and an auxiliary measurement unit are provided on the crossbeam.

In an embodiment, the carrier further includes square cabins arranged in an integrated manner.

Each of the square cabins is used to install all measuring devices and supporting environments required for measurement. All measuring devices may include but not limited to a velocity measurement unit, an attitude measurement unit and an auxiliary measurement unit, etc.

The crossbeam can be a specially made rigid crossbeam inside each square cabin.

The velocity measurement unit includes a second velocity measurement sensor and at least three first velocity measurement sensors. Each of the first velocity measurement sensors is used to measure the vertical deformation velocities of the pavement in the target deflection basin. The second velocity measurement sensor is installed outside the deflection basin and is used to eliminate the velocity noise included in the measurement of the first velocity measurement sensor in the deflection basin.

In an embodiment, the velocity measurement unit may include at least three first velocity measurement sensors and one second velocity measurement sensor. The first velocity measurement sensors and the second velocity measurement sensor may be any velocity measurement sensor (that is, a velocimeter) for measuring the deformation velocity of the pavement.

Each of the first velocity measurement sensors and the second velocity measurement sensor can be installed collinearly along the moving direction of the carrier.

The first velocity measurement sensor is a velocity measurement sensor inside the deflection basin and is used to measure the vertical deformation velocities of the pavement at different positions from a center of the load.

The second velocity measurement sensor is a velocity measurement sensor outside the deflection basin and is used as a reference velocity measurement sensor to compensate the velocity noise measured by the velocity measurement sensors inside the deflection basin (i.e., the first velocity measurement sensors). The velocity noise is a component velocity noise in the movement direction of the load. The velocity noise measured by the first velocity measurement sensors is a noise contained in velocity measurement results obtained by the first velocity measurement sensors.

The attitude measurement unit is used to measure an attitude angular velocity of the crossbeam.

In an embodiment, the attitude measurement unit may include a plurality of gyroscopes. The gyroscopes can be any kind of gyroscope. The attitude angular velocity can include pitch angular velocity, a roll angular velocity and a yaw angular velocity.

Exemplarily, the attitude measurement unit may include three fiber-optic gyroscopes.

The auxiliary measurement unit includes a positioning subunit used to obtain a position of the load and a traveling speed of the carrier on the pavement.

In an embodiment, the positioning subunit can be used to position the load based on at least one global navigation satellite system (GNSS), or any kind of distance measuring instrument (DMI), or a global satellite navigation system in conjunction with a distance measuring instrument and a travelling speed of the carrier on the pavement can be obtained by measuring the distance change between the carrier and a fixed target within a preset time period.

Exemplarily, the global navigation satellite system can be Beidou, Galileo, GLONASS, or a global positioning system (GPS).

The positioning subunit can also be used to perform timing.

At a certain timing, vertical deformation velocities of the pavement at a measurement point (that is, a target location) corresponding to a plurality of first velocity measurement sensors within the deflection basin can be obtained based on measured values of the second velocity measurement sensor installed outside the deflection basin, an installation angle of the second velocity measurement sensor, a rotation velocity of the carrier, a velocity of movement of the carrier along the driving direction, measured values of the first velocity measurement sensors and installation angles of the first velocity measurement sensors.

In an embodiment, a measured value of each of the first velocity measurement sensors can be regarded as a resultant velocity (that is, the resultant velocity of the vertical deformation velocity of pavement, the rotation velocity and vibration velocity, etc.). Therefore, the non-vertical component velocity noise of the pavement deformation velocity can be removed from the measured values of the first velocity measurement sensor and the second velocity measurement sensor based on the installation angle of the second velocity measurement sensor, installation angles of the first velocity measurement sensors, the rotation velocity of the carrier and the velocity of movement of the carrier along the driving direction, etc. to obtain the vertical deformation velocities of the pavement.

The rotation velocity of the carrier can be obtained through the attitude measurement unit.

The velocity of movement of the carrier along the driving direction, that is, the traveling speed of the carrier on the pavement, can be obtained by the positioning subunit.

The carrier can move, under control of the towing device, on the pavement and applies load to the pavement during the movement. Therefore, the vertical deformation velocities of the pavement at each target location can be obtained at different timings based on the continuous deflection velocity measurement subsystem.

In an embodiment, at least four target locations may be preset in the target deflection basin. Among the above at least four target locations, a location in the target deflection basin where a measurement point corresponding to a central location of a load is located is a first measurement point and locations where measurement points in the target deflection basin except the central location of the load are located are second measurement points. The measurement point is a point to be measured.

Assuming that at any timing $t_m$, the location of the center of the load (that is, the first measurement point) at this timing is $x_m$, vertical deformation velocities of the pavement corresponding to a plurality of locations in the target deflection basin at that timing is obtained through the continuous deflection velocity measurement subsystem and denoted as $\{VR_{1,t_m x_m+L_1}, VR_{2,t_m x_m+L_2}, L, VR_{n,t_m x_m+L_n}\}$. $VR_{i,t_m x_m+L_i}$ (i=1, 2, L, n) represent vertical deformation velocities of the pavement at the position of the measurement point $x_m+L_i$ (that is, the position of the corresponding second measurement point) obtained by the first velocity measurement sensors in the target deflection basin at the timing of $t_m$; n represents the number of the second measurement points within the target deflection basin and $L_i$ represents a horizontal distance between a measurement point at the center of the load and i-th second measurement point within the target deflection basin. In an embodiment, the number of second measurement points within the target deflection basin is equal to the number of first velocity measurement sensors.

Vertical deformation velocities of the pavement obtained by different first velocity measurement sensors at different timings at the same first measurement point ($x_m$) are matched based on location information of a plurality of second measurement points within the target deflection basin and moving position information of the load are denoted as $\{VR_{i,t_i x_m} | i=1, 2, L, n\}$ where $t_i$ is a timing when an i-th first measurement point within the target deflection basin measures a current measurement point ($x_m$).

The location information of second measurement points can be determined based on the installation location and installation angle of the first velocity measurement sensor in the continuous deflection velocity measurement subsystem.

The moving position information of the load may include position information of the load at each measurement timing corresponding to each target location during the moving process of the load.

It can be understood that, for each target location, timings when the first velocity measurement sensors pass the target location can be calculated based on the velocity of movement of the load and the horizontal installation location of the velocimeter in the system for detecting the deflection basin and regarded as respective measurement timings corresponding to the target locations.

In step 102, durations for respective response time intervals corresponding to the respective target locations are obtained based on the respective measurement timings corresponding to the respective target locations, the vertical deformation velocities of the pavement at the respective measurement timings corresponding to the respective target locations and a knowledge base model for the vertical deformation velocities of the pavement.

In an embodiment, the knowledge base model for the vertical deformation velocities of the pavement can be used to characterize relationships between the vertical deformation velocities of the pavement, the velocity of movement of the load, and the weight of the load.

Before step 102, the method may further include: obtaining the knowledge base model for the vertical deformation velocities of the pavement.

In an embodiment, the knowledge base model for the vertical deformation velocities of the pavement can be obtained in any of the following schemes, but not limited to the following schemes.

Scheme 1: a plurality of typical road sections are selected, vertical deformation velocities of the pavement at different driving speeds through embedded accelerometer and the continuous deflection velocity measurement subsystem are collected, a relationship model between the vertical deformation velocities of the pavement obtained by the accelerometer and the vertical deformation velocities of the pavement obtained by the continuous deflection velocity measurement subsystem is established through a statistical analysis method or artificial intelligence method to obtain the knowledge base model of the vertical deformation velocities of the pavement.

Scheme 2: For a plurality of typical road sections, the knowledge base model of the vertical deformation velocities of the pavement is obtained in conjunction with a theoretical model of pavement response under the rolling load.

Scheme 3: For a plurality of typical road sections, a model of the vertical deformation velocities of the pavement is established and corrected by comparing and analyzing a relationship between a deflection basin measured by FWD and a deflection basin measured by the continuous deflection velocity measurement subsystem to obtain the knowledge base model of the vertical deformation velocities of the pavement.

A response time period of the current first measurement point under the rolling load can be estimated based on the respective first durations, the vertical deformation velocities of the pavement at each measurement time corresponding to the respective target locations and the knowledge base model of the vertical deformation velocities of the pavement.

The response time period of the current first measurement point under the rolling load can be divided into a plurality of response time intervals based on the respective measurement timings corresponding to the respective target locations and the durations for respective response time intervals corresponding to the respective target locations are obtained.

A set of the respective response time intervals corresponding to the respective target locations can be denoted as $ET_i$ ($ET_i \in \{VT_j | j=i, i+1, L, n\}$), i=0, 1, 2, L, n, where $ET_i$ (i=1, 2, L, n) is a set of response time intervals of the second measurement point corresponding to the i-th first velocity measurement sensor within the target deflection basin, and $ET_0$ is a set of response time intervals of the center of the load (that is, first measurement point).

A time difference for vertical deformation velocities of the pavement at the adjacent timings corresponding to the same first measurement point is a difference between times when the adjacent first velocity measurement sensors within the deflection basin pass the first measurement point and can be denoted as $\{VT_i = t_i - t_{i+1} | i=1, 2, L, n-1\}$.

In step 103, the representative vertical deformation velocities of the pavement for respective response time intervals corresponding to the respective target locations are obtained based on the vertical deformation velocities of the pavement at respective measurement timings corresponding to respective target locations, the durations for respective response time intervals corresponding to the respective target locations and the knowledge base model of the vertical deformation velocities of the pavement.

In an embodiment, for each target location corresponding to each response time interval, representative vertical deformation velocities of the pavement for the response time interval corresponding to the target location can be regarded as an average vertical deformation velocity of the pavement in the response time interval corresponding to the target location.

For any target location, the representative vertical deformation velocities of the pavement for respective response time intervals corresponding to the target locations are obtained based on the vertical deformation velocities of the pavement at respective measurement timings corresponding to the target location, the durations for respective response time intervals corresponding to the target location and the knowledge base model of the vertical deformation velocities of the pavement.

In step 104, detection results of the target deflection basin are obtained based on the representative vertical deformation velocities of the pavement at the respective response time intervals corresponding to the respective target locations and the durations for respective response time intervals corresponding to the respective target locations.

In an embodiment, the deflection basin means that the center of the load is at the first measurement point, and different second measurement points have different deformation amount, which forms a shape similar to a basin.

A deflection value of each target location in the target deflection basin can be obtained based on the representative road vertical deformation velocity of each response time interval corresponding to each target location and the period of each response time interval corresponding to each target location and thus a shape of the target deflection basin is obtained.

The rapid detection of the continuous deflection basin is performed by detecting the deflection basin based on the vertical deformation velocities of the pavement under the rolling load and the problems of low detection efficiency, strong subjectivity, high risk and wasting time and energy in the traditional detection of the deflection basin can be solved. The efficiency and safety in detection of the deflection basin can be improved and deflection values of the entire deflection basin can be obtained, which can solve the problem of inability to characterize the load bearing performance of a certain structural layer since traditional laser dynamic deflectometer system can only measure the maximum deflection value at the center of the load. Detection results of the deflection basin are less affected by the environment and not affected by the texture of the pavement and thus the detection results have higher accuracy.

Based on any of the above embodiments, the method is applicable to the detection of deflection basins on highway pavement or airport pavement.

After obtaining the detection results of the target deflection basin based on the representative vertical deformation velocities of the pavement at the respective response time intervals corresponding to the respective target locations and the durations for respective response time intervals corresponding to the respective target locations, the method further includes:

correcting the detection results of the target deflection basin based on measurement environment information of the target deflection basin and a knowledge base model for correction of deflection basin.

In an embodiment, the measured environmental information may include a pavement surface temperature, the velocity of movement of the load, the weight of the load, etc.

The knowledge base model for correction of deflection basin can be used to characterize a relationship between the detection results of the deflection basin and the pavement surface temperature, the velocity of movement of the load and the weight of the load.

After obtaining the detection results of the target deflection basin, the detection results of the target deflection basin can be corrected based on the measurement environment information of the target deflection basin and a knowledge base model for correction of deflection basin to obtain more accurate detection results of the deflection basin.

In an embodiment, before correcting the detection results of the target deflection basin based on measurement environment information of the target deflection basin and a knowledge base model for correction of deflection basin, the method further includes: obtaining the measurement environment information of the target deflection basin.

In an embodiment, the pavement surface temperature can be obtained through a thermometer included in the auxiliary measurement unit. The thermometer can be any kind of thermometer, for example an infrared thermometer.

In an embodiment, before correcting the detection results of the target deflection basin based on measurement environment information of the target deflection basin and a knowledge base model for correction of deflection basin, the method further includes: establishing the knowledge base model for correction of deflection basin.

In an embodiment, the knowledge base model for correction of deflection basin can be obtained in the following scheme, but not limited to the following scheme.

A plurality of typical road sections and typical climates are selected. For various typical road sections, the measurement results at different velocities of movement of the load and different pavement surface temperatures are collected within $T_h$ hours and then the knowledge base model for correction of deflection basin is established by using the measurement results at a specific temperature of $T_c$ and a specific test speed of $T_v$ as a standard.

In the embodiment of the present application, the accuracy of the detection results of the target deflection basin can be improved by correcting the detection results of the target deflection basin based on measurement environment information of the target deflection basin and a knowledge base model for correction of deflection basin.

Based on any of the above-mentioned embodiments, the obtaining durations for respective response time intervals corresponding to the respective target locations based on the respective measurement timings corresponding to the respective target locations, the vertical deformation velocities of the pavement at the respective measurement timings corresponding to the respective target locations and a knowledge base model for the vertical deformation velocities of the pavement, includes:

obtaining respective first durations based on the respective measurement timings corresponding to the respective target locations, where each of the respective first durations is a time difference between two adjacent measurement timings corresponding to any of the target locations.

In an embodiment, the first duration is the time difference between two adjacent measurement timings corresponding to any target location, that is, a difference between times when two adjacent first velocity measurement sensors pass the same target location.

A time difference for vertical deformation velocities of the pavement at the adjacent timings corresponding to the same first measurement point is a difference between times when the adjacent first velocity measurement sensors within the deflection basin pass the first measurement point and can be denoted as $\{VT_i=t_i-t_{i+1}|i=1, 2, L, n-1\}$.

A response start time and a response end time of the first measurement point under the load are obtained based on the respective first durations, vertical deformation velocities of the pavement at respective measurement timings corresponding to the first measurement point and the knowledge base model for the vertical deformation velocities of the pavement.

In an embodiment, a first rate of change of vertical deformation velocities of the pavement is obtained based on the respective first durations and the vertical deformation velocities of the pavement at the plurality of measurement timings corresponding to the first measurement point and being close to the response start time of the first measurement point under the load; and the response start time of the first measurement point under the load is obtained based on the first rate of change and the knowledge base model for the vertical deformation velocities of the pavement.

In an embodiment, a first rate of change of vertical deformation velocities of the pavement is obtained based on the respective first durations and the vertical deformation velocities of the pavement at the plurality of measurement timings corresponding to the first measurement point and being close to the response end time of the first measurement point under the load; the response end time of the first measurement point under the load is obtained based on the first rate of change and the knowledge base model for the vertical deformation velocities of the pavement.

Durations for respective response time intervals corresponding to the first measurement point are obtained based on respective measurement timings corresponding to the first measurement point and the response start time and the response end time of the first measurement point under the load.

In an embodiment, the response start time and the response end time of the first measurement point under the rolling load may define the response time period of the first measurement point under the rolling load. The response time period of the first measurement point under the rolling load can be divided into a plurality of response time intervals based on the respective measurement timings corresponding to the first measurement point and the durations for respective response time intervals corresponding to the first measurement point are obtained.

A response start time of the second measurement points under the load is obtained based on the respective first durations, vertical deformation velocities of the pavement at respective measurement timings corresponding to the second measurement points and the knowledge base model for the vertical deformation velocities of the pavement.

In an embodiment, for each second measurement point, a second rate of change of vertical deformation velocities of the pavement is obtained based on the respective first durations and the vertical deformation velocity of the pavement at one or more measurement timings corresponding to each of the second measurement points and being close to the response start time of the second measurement points under the load; the response start time of the second measurement points under the load is obtained based on the second rate of change and the knowledge base model for the vertical deformation velocities of the pavement.

Durations for respective response time intervals corresponding to the second measurement points are obtained based on respective measurement timings corresponding to the second measurement points and the response start time of the second measurement points under the load.

In an embodiment, for each second measurement point, the response start time and the response end time of the second measurement points under the rolling load may define the response time period of the second measurement points under the rolling load. The response time period of the second measurement points under the rolling load can be divided into a plurality of response time intervals based on the respective measurement timings corresponding to the second measurement points and the durations for respective response time intervals corresponding to the second measurement points are obtained.

In the embodiment of the present application, durations for respective response time intervals corresponding to the respective target locations are obtained based on the respective measurement timings corresponding to the respective target locations, the vertical deformation velocities of the pavement at the respective measurement timings corresponding to the respective target locations, information on a moving position of the load and a knowledge base model for the vertical deformation velocities of the pavement and more accurate detection results of the deflection basin can be obtained based on the durations for respective response time intervals corresponding to the respective target locations.

Based on any of the above-mentioned embodiments, the obtaining detection results of the target deflection basin based on the representative vertical deformation velocities of the pavement at the respective response time intervals corresponding to the respective target locations and the durations for respective response time intervals corresponding to the respective target locations, includes:

obtaining accumulative vertical deformation amount corresponding to each target location based on the representative vertical deformation velocities of the pavement at respective response time intervals corresponding to each target location and durations for the respective response time intervals.

In an embodiment, the accumulative vertical deformation amount for the target location can reflect the shape of the target location in the target deflection basin.

The location of the first measurement point is $x_m$, and a vertical deformation amount $DEF_i$ (i=0, 1, 2,L, n) of each target location in the target deflection basin is calculated, where $DEF_i$ (i=1, 2, L, n) represents the accumulative vertical deformation amount of the second measurement point corresponding to the i-th first velocity measurement sensor within the target deflection basin, and $DEF_o$ represents the accumulative vertical deformation amount of the first measurement point.

The accumulative vertical deformation amount of the respective target locations is determined as the detection results of the target deflection basin.

In an embodiment, the detection results of the target deflection basin may include the accumulative vertical deformation amount of the respective target locations.

In the embodiment of the present application, the accumulative vertical deformation amount for the target location is obtained based on the representative vertical deformation velocities of the pavement at respective response time intervals corresponding to the target location and durations for the respective response time intervals and more accurate detection results of the deflection basin can be obtained.

Based on any of the above-mentioned embodiments, the obtaining the accumulative vertical deformation amount corresponding to each target location based on the representative vertical deformation velocities of the pavement at respective response time intervals corresponding to each target location and durations for the respective response time intervals, includes:

obtaining each product of a representative pavement vertical deformation velocity at each response time interval corresponding to the target location and a duration for each response time interval; and determining a sum of all products as the accumulative vertical deformation amount corresponding to each target location.

In an embodiment, the location of the first measurement point is $x_m$, a vertical deformation amount $DEF_i$ (i=0, 1, 2,L, n) of each target location in the target deflection basin is calculated by the following formula:

$$DEF_i = \sum_{i}^{n} VT_i * RV_{i,x_m+L_i} (i = 0, 1, 2, L, n).$$

In the embodiment of the present application, more accurate detection results of the deflection basin are determined by obtaining the sum of the products of the representative pavement vertical deformation velocities at each response time interval corresponding to the target location by the duration for each response time interval as the accumulative vertical deformation amount corresponding to each target location.

Based on any of the above-mentioned embodiments, the obtaining the representative vertical deformation velocities of the pavement for respective response time intervals corresponding to the respective target locations, based on the vertical deformation velocities of the pavement at respective measurement timings corresponding to respective target locations, the durations for respective response time intervals corresponding to the respective target locations and the knowledge base model of the vertical deformation velocities of the pavement, includes:

for each one of the target locations, obtaining representative vertical deformation velocities of the pavement at the respective response time intervals corresponding to the target location based on vertical deformation velocities of the pavement at different measurement timings corresponding to the target location, the durations for respective response time intervals corresponding to the target locations, and the knowledge base model for the vertical deformation velocities of the pavement.

In an embodiment, vertical deformation velocities of the pavement at different measurement timings corresponding to the target location can be fitted based on the durations for respective response time intervals corresponding to the target location, and the knowledge base model for the vertical deformation velocities of the pavement to obtain a curve or an equation of the vertical deformation velocities corresponding to the target location as a function of time within the response time period for the current first measurement point under the rolling load; and representative vertical deformation velocities of the pavement at the respective response time intervals corresponding to the target location are obtained based on the curve or the equation.

In an embodiment, a changing law of the vertical deformation velocities over time at each response time interval corresponding to the target location can be obtained based on the vertical deformation velocities of the pavement at respective measurement timings corresponding to the target location, the durations for respective response time intervals corresponding to the target location and the knowledge base model of the vertical deformation velocities of the pavement; and representative vertical deformation velocities of the pavement at the respective response time intervals corresponding to the target location are obtained based on the changing law.

In the embodiments of the present application, by obtaining representative vertical deformation velocities of the pavement at the respective response time intervals corresponding to the respective target locations, the deflection basin can be quickly detected based on the representative vertical deformation velocities of the pavement. Based on any of the above embodiments, the detection results of the target deflection basin, includes accumulative vertical deformation amount corresponding to the respective target locations.

The correcting the detection results of the target deflection basin based on measurement environment information of the target deflection basin and a knowledge base model for correction of deflection basin, includes:

obtaining a correction coefficient for each target location based on the measurement environment information of the target deflection basin and the knowledge base model for correction of deflection basin.

In an embodiment, correction coefficients $\{F_i | i=0, 1, 2, \ldots, n\}$ for respective target locations can be calculated based on the measurement environment information of the target deflection basin and the knowledge base model for correction of deflection basin.

The correction coefficient is used to correct an error of the accumulative vertical deformation amount for the target location caused by the measurement environment information.

For each target location, the accumulative vertical deformation amount for the target location is corrected based on the correction coefficient for each target location.

In an embodiment, the detection results of the deflection basin at each measurement point can be corrected based on the correction coefficient for each target location in the deflection basin by the following corrected formula:

$$DEF_i' = DEF_i * F_i (i = 0, 1, 2, L, n),$$

where $DEF_i'$ represents the corrected accumulative vertical deformation amount of the second measurement point corresponding to the i-th first velocity measurement sensor within the target deflection basin.

In the embodiment of the present application, by obtaining a correction coefficient for each target location based on the measurement environment information of the target deflection basin and the knowledge base model for correction of deflection basin and for each target location, correcting the accumulative vertical deformation amount for the target location based on the correction coefficient for each target location, the accuracy of the detection results of the deflection basin can be further improved.

Based on any of the above-mentioned embodiments, the obtaining the response start time and the response end time of the first measurement point under the load based on the respective first durations, vertical deformation velocities of the pavement at respective measurement timings corresponding to the first measurement point, and the knowledge base model for the vertical deformation velocities of the pavement, includes:

obtaining the response start time of the first measurement point under the load based on the respective first durations, vertical deformation velocities of the pavement at a plurality of measurement timings corresponding to the first measurement point and being close to the response start time of the first measurement point under the load and the knowledge base model for the vertical deformation velocities of the pavement; and obtaining the response end time of the first measurement point under the load based on the respective first durations, vertical deformation velocities of the pavement at a plurality of measurement timings corresponding to the first measurement point and being close to the response end time of the first measurement point under the load, the knowledge base model for the vertical deformation velocities of the pavement, information on a moving position of the load and movement velocity information of the load.

In an embodiment, in terms of the knowledge base model for the vertical deformation velocities of the pavement, the response start time of the first measurement point under the load is estimated based on the respective first durations, vertical deformation velocities of the pavement at a plurality of (for example, u, which can be an integer greater than or equal to 2) measurement timings corresponding to the first measurement point and being close to the response start time of the first measurement point under the load.

The response end time of the first measurement point under the load can be a time corresponding to the load moving to the first measurement point, or a time corresponding to a certain timing after the load leaves the first measurement point (there is a lag in the response at the measurement point currently).

A first rate of change of vertical deformation velocities of the pavement is obtained based on the respective first durations and the vertical deformation velocities of the pavement at the plurality of measurement timings corresponding to the first measurement point and being close to the response end time of the first measurement point under the load, the response end time of the first measurement point under the load is obtained based on the first rate of change and the knowledge base model for the vertical deformation velocities of the pavement and is denoted as to.

In the embodiment of the present application, by obtaining the response start time of the first measurement point under the load based on the respective first durations, vertical deformation velocities of the pavement at a plurality of measurement timings corresponding to the first measurement point being close to the response start time of the first measurement point under the load and the knowledge base model for the vertical deformation velocities of the pavement and obtaining the response end time of the first measurement point under the load based on information on a moving position of the load and movement velocity information of the load, the durations for respective response time intervals corresponding to the respective target locations can be obtained and more accurate detection results of the deflection basin can be obtained based on the durations for respective response time intervals corresponding to the respective target locations.

Based on any of the above-mentioned embodiments, the obtaining the response start time of the first measurement point under the load includes: obtaining a first rate of change of vertical deformation velocities of the pavement based on the respective first durations and the vertical deformation velocities of the pavement at the plurality of measurement timings corresponding to the first measurement point and being close to the response start time of the first measurement point under the load.

In an embodiment, the first rate of change of vertical deformation velocities of the pavement at measurement timings close to the response start time can be obtained based on the respective first durations and the vertical deformation velocities of the pavement at the plurality of measurement timings corresponding to the first measurement point and being close to the response start time of the first measurement point under the load.

The response start time of the first measurement point under the load is obtained based on the first rate of change and the knowledge base model for the vertical deformation velocities of the pavement.

In an embodiment, the response start time of the first measurement point under the load can be estimated based on the first rate of changes close to the response start time of the first measurement point and the knowledge base model for the vertical deformation velocities of the pavement and be denoted as $t_{n+1}$.

The obtaining the response start time of the second measurement points under the load includes:

obtaining a second rate of change of vertical deformation velocity of the pavement based on the respective first durations and the vertical deformation velocities of the pavement at one or more measurement timings corresponding to each of the second measurement points and being close to the response start time of the second measurement points under the load.

In an embodiment, for each of the second measurement points, in terms of the knowledge base model for the vertical deformation velocities of the pavement, a second rate of change of vertical deformation velocities of the pavement is estimated based on the respective first durations and the vertical deformation velocities of the pavement at one or more (for example, v, which can be an integer greater than or equal to 2) measurement timings corresponding to the second measurement points and being close to the response start time of the second measurement points under the load.

The response start time of the second measurement points under the load is obtained based on the second rate of change and the knowledge base model for the vertical deformation velocities of the pavement.

In an embodiment, for each of the second measurement points, the response start time of the second measurement points under the load can be estimated based on the second rates of change close to the response start time of the second measurement points and the knowledge base model for the vertical deformation velocities of the pavement.

The obtaining the response end time of the first measurement point under the load includes: obtaining a first rate of change of vertical deformation velocities of the pavement based on the respective first durations and the vertical deformation velocities of the pavement at the plurality of measurement timings corresponding to the first measurement point and being close to the response end time of the first measurement point under the load.

The response end time of the first measurement point under the load is obtained based on the first rate of change and the knowledge base model for the vertical deformation velocities of the pavement.

In an embodiment, based on the knowledge base model for the vertical deformation velocities of the pavement, the response end time of the first measurement point under the load can be estimated based on the first rate of change close to the response end time of the first measurement point.

In the embodiment of the present application, by obtaining rates of change of vertical deformation velocities of the pavement based on the respective first durations and the vertical deformation velocities of the pavement at the plurality of measurement timings corresponding to the first measurement point and being close to the response start time of the first measurement point under the load and obtaining the response start time and the response end time of the first measurement point under the load based on the rates of change and the knowledge base model for the vertical deformation velocities of the pavement, the durations for respective response time intervals corresponding to the respective target locations can be obtained and more accurate detection results of the deflection basin can be obtained based on the durations for respective response time intervals corresponding to the respective target locations.

In order to illustrate the above-mentioned embodiments of the present application, the implementation process of a method for quickly detecting a deflection basin based on deformation velocities of a pavement under a rolling load will be described below.

Figure 2:
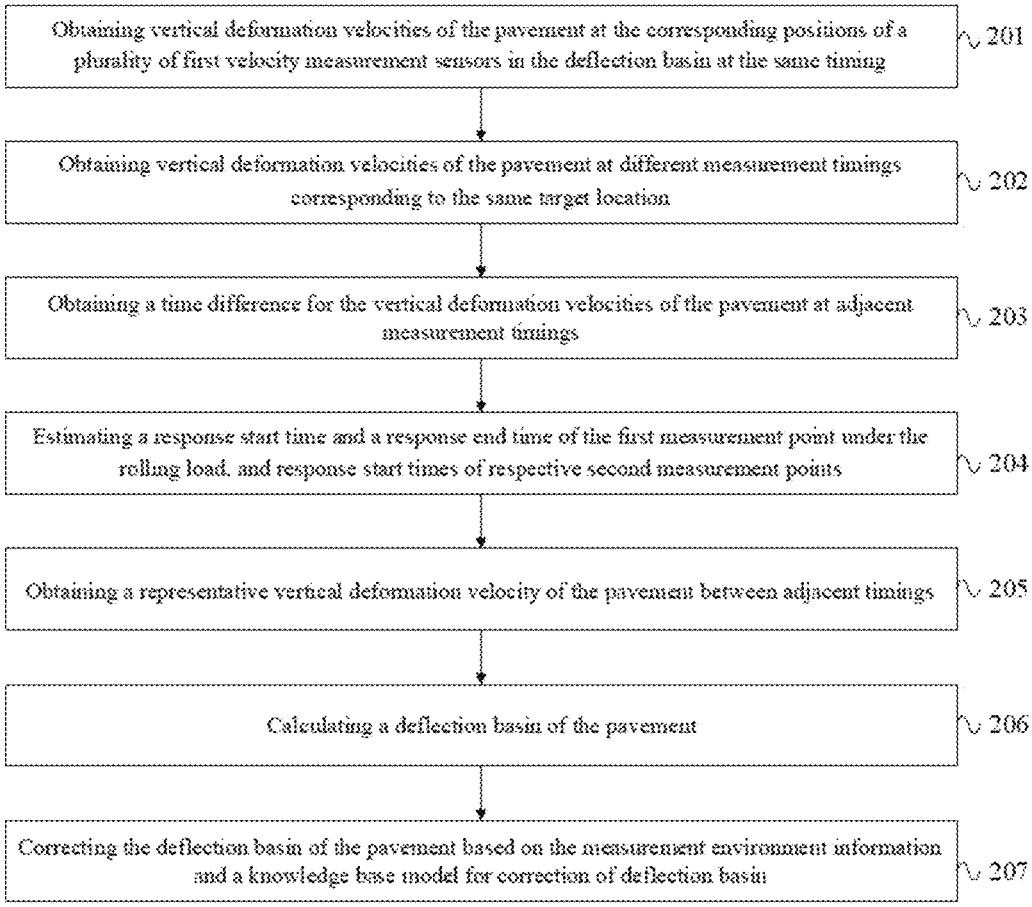
FIG. 2 is a second schematic flow chart of a method for detecting a deflection basin based on deformation velocities of a pavement under a rolling load according to the present application.

FIG. 2 is a second schematic flow chart of a method for detecting a deflection basin according to the present application. As shown in FIG. 2, the method for quickly detecting the deflection basin based on vertical deformation velocity of the pavement under the rolling load may include the following steps:

step 201: obtaining vertical deformation velocities of the pavement at the corresponding positions of a plurality of first velocity measurement sensors in the deflection basin at the same timing;

step 202: obtaining vertical deformation velocities of the pavement at different measurement timings corresponding to the same target location;

step 203: obtaining a time difference for the vertical deformation velocities of the pavement at adjacent measurement timings;

step 204, estimating a response start time and a response end time of the first measurement point under the rolling load, and response start times of respective second measurement points;

step 205, obtaining a representative vertical deformation velocity of the pavement between adjacent timings;

step 206, calculating a deflection basin of the pavement; and step 207, correcting the deflection basin of the pavement based on the measurement environment information and a knowledge base model for correction of deflection basin.

An apparatus for detecting a deflection basin according to the present application is described below and the apparatus for detecting the deflection basin described below and the method for detecting the deflection basin described above can be referred to each other.

Figure 3:
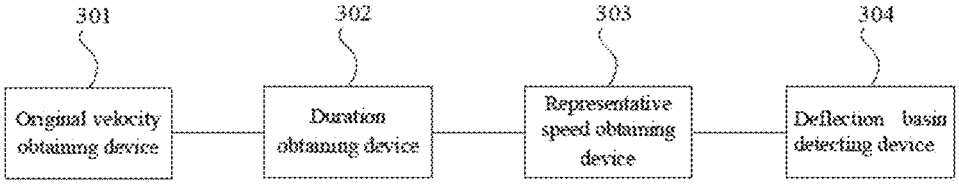
FIG. 3 is a schematic structural diagram of an apparatus for detecting a deflection basin based on deformation velocities of a pavement under a rolling load according to the present application.

FIG. 3 is a schematic structural diagram of an apparatus for detecting a deflection basin based on deformation velocities of a pavement under a rolling load according to the present application. Based on any of the above embodiments, as shown in FIG. 3, the apparatus includes: an original velocity obtaining device 301, a duration obtaining device 302, a representative speed obtaining device 303 and a deflection basin detecting device 304, wherein the original velocity obtaining device 301, used to obtain vertical deformation velocities of the pavement at respective measurement timings corresponding to respective target locations in a target deflection basin during the load movement;

the duration obtaining device 302, used to obtain durations for respective response time intervals corresponding to the respective target locations based on the respective measurement timings corresponding to the respective target locations, the vertical deformation velocities of the pavement at the respective measurement timings corresponding to the respective target locations and a knowledge base model for the vertical deformation velocities of the pavement;

the representative speed obtaining device 303, used to obtain representative vertical deformation velocities of the pavement at the respective response time intervals corresponding to the respective target locations based on the vertical deformation velocities of the pavement at the respective measurement timings corresponding to the respective target locations, the durations for respective response time intervals corresponding to the respective target locations, and the knowledge base model for the vertical deformation velocities of the pavement; and the deflection basin detecting device 304, used to obtain detection results of the target deflection basin based on the representative vertical deformation velocities of the pavement at the respective response time intervals corresponding to the respective target locations and the durations for respective response time intervals corresponding to the respective target locations, where the respective target locations include a first measurement point and at least three second measurement points, the first measurement point is a location in the target deflection basin where a measurement point corresponding to a central location of a load is located, the second measurement points are locations where measurement points in the target deflection basin except the central location of the load are located; and each of the respective measurement timings corresponding to respective target locations is calculated from a speed of load movement and a horizontal installation location of a velocimeter in a system for detecting a deflection basin.

In an embodiment, the original velocity obtaining device 301, the duration obtaining device 302, the representative speed obtaining device 303 and the deflection basin detecting device 304 may be electrically connected in sequence.

The original velocity obtaining device 301 can obtain vertical deformation velocities of the pavement at respective measurement timings corresponding to respective target locations in a target deflection basin during the load movement through a continuous deflection velocity measurement subsystem.

The period obtaining device 302 can estimate a response time period of the current first measurement point under the rolling load based on the respective first durations, the vertical deformation velocities of the pavement at each measurement time corresponding to the respective target locations and the knowledge base model of the vertical deformation velocities of the pavement; divide the response time period of the current first measurement point under the rolling load into a plurality of response time intervals based on the respective measurement timings corresponding to the respective target locations to obtain the durations for respective response time intervals corresponding to the respective target locations.

The representative speed obtaining device 303 can, for any target location, obtain representative vertical deformation velocities of the pavement at the respective response time intervals corresponding to the target location based on the vertical deformation velocities of the pavement at the respective measurement timings corresponding to the target location, the durations for respective response time intervals corresponding to the target location, and the knowledge base model for the vertical deformation velocities of the pavement.

The deflection basin detecting device 304 can obtain detection results of the target deflection basin based on the representative vertical deformation velocities of the pavement at the respective response time intervals corresponding to the respective target locations and the durations for respective response time intervals corresponding to the respective target locations and to obtain the shape of the target deflection basin.

In an embodiment, the apparatus for detecting the deflection basin may further include:

a correcting device, used to correct the detection results of the target deflection basin based on measurement environment information of the target deflection basin and a knowledge base model for correction of deflection basin.

In an embodiment, the duration obtaining device 302 may include:

a first duration obtaining unit, used to obtain respective first duration based on respective measurement timings corresponding to any target location;

a first response time obtaining unit, used to obtain a response start time and a response end time of the first measurement point under the load based on the respective first durations, vertical deformation velocities of the pavement at respective measurement timings corresponding to the first measurement point, information on a moving position of the load and the knowledge base model for the vertical deformation velocities of the pavement;

a second duration obtaining unit, used to obtain durations for respective response time intervals corresponding to the first measurement point based on respective measurement timings corresponding to the first measurement point and the response start time and the response end time of the first measurement point under the load;

a second response time obtaining unit, used to obtain a response start time of the second measurement points under the load based on the respective first durations, vertical deformation velocities of the pavement at respective measurement timings corresponding to the second measurement points and the knowledge base model for the vertical deformation velocities of the pavement; and a third duration obtaining unit, used to obtain durations for respective response time intervals corresponding to the second measurement points based on respective measurement timings corresponding to the second measurement points and the response start times of the second measurement points under the load.

In an embodiment, the deflection basin detecting device 304 may include:

an accumulative deformation obtaining unit, used to obtain, for each target location, accumulative vertical deformation amount corresponding to the target location based on the representative vertical deformation velocities of the pavement at respective response time intervals corresponding to the target location and durations for the respective response time intervals; and a detection result obtaining unit, used to determine accumulative vertical deformation amount of each of the respective target locations as a detection result of the target deflection.

In an embodiment, the accumulative deformation obtaining unit may be used to multiply representative pavement vertical deformation velocity at each response time interval corresponding to the target location by a duration for each response time interval; and determine a sum of all products as the accumulative vertical deformation amount corresponding to the target location.

In an embodiment, the detection results of the target deflection basin include the accumulative vertical deformation amount corresponding to the respective target locations;

the correcting device can be used to obtain a correction coefficient for each target location based on the measurement environment information of the target deflection basin and the knowledge base model for correction of deflection basin; and for each target location, correct the accumulative vertical deformation amount for the target location based on the correction coefficient for each target location.

In an embodiment, the response time obtaining unit may include:

a response start time obtaining subunit, used to obtain the response start time of the first measurement point under the load based on the respective first durations, vertical deformation velocities of the pavement at a plurality of measurement timings corresponding to the first measurement point and being close to the response start time of the first measurement point under the load and the knowledge base model for the vertical deformation velocities of the pavement; and a response end time obtaining subunit, used to obtain the response end time of the first measurement point under the load based on the respective first durations, vertical deformation velocities of the pavement at a plurality of measurement timings corresponding to the first measurement point and being close to the response end time of the first measurement point under the load, the knowledge base model for the vertical deformation velocities of the pavement, information on a moving position of the load and movement velocity information of the load.

In an embodiment, the response time obtaining unit may obtain a first rate of change of vertical deformation velocities of the pavement based on the respective first durations and the vertical deformation velocities of the pavement at the plurality of measurement timings corresponding to the first measurement point and being close to the response start time of the first measurement point under the load; and obtain the response start time of the first measurement point under the load based on the first rate of change and the knowledge base model for the vertical deformation velocities of the pavement.

In an embodiment, the response time obtaining unit may further obtain a second rate of change of vertical deformation velocity of the pavement based on the respective first durations and the vertical deformation velocities of the pavement at one or more measurement timings corresponding to each of the second measurement points and being close to the response start time of the second measurement points under the load; and obtain the response start time of the second measurement points under the load based on the second rate of change and the knowledge base model for the vertical deformation velocities of the pavement.

In an embodiment, the response time obtaining unit may be further used to obtain the response end time of the first measurement point under the load, including:

obtaining a first rate of change of vertical deformation velocities of the pavement based on the respective first durations and the vertical deformation velocities of the pavement at the plurality of measurement timings corresponding to the first measurement point and being close to the response end time of the first measurement point under the load; and obtaining the response end time of the first measurement point under the load based on the first rate of change and the knowledge base model for the vertical deformation velocities of the pavement.

The apparatus for detecting the deflection basin according to the embodiment of the present application is used to implement the method for detecting the deflection basin of the present application mentioned above and has an implementation mode consistent with that of the method for detecting the deflection basin and can achieve the same beneficial effect, which is not repeated herein.

The rapid detection of the continuous deflection basin is performed by detecting the deflection basin based on the vertical deformation velocities of the pavement under the rolling load and the problems of low detection efficiency, strong subjectivity, high risk and wasting time and energy in the traditional detection of the deflection basin can be solved. The efficiency and safety in detection of the deflection basin can be improved and deflection values of the entire deflection basin can be obtained, which can solve the problem of inability to characterize the load bearing performance of a certain structural layer since traditional laser dynamic deflectometer system can only measure the maximum deflection value at the center of the load. Detection results of the deflection basin are less affected by the environment and not affected by the texture of the pavement and thus the detection results have higher accuracy.

Figure 4:
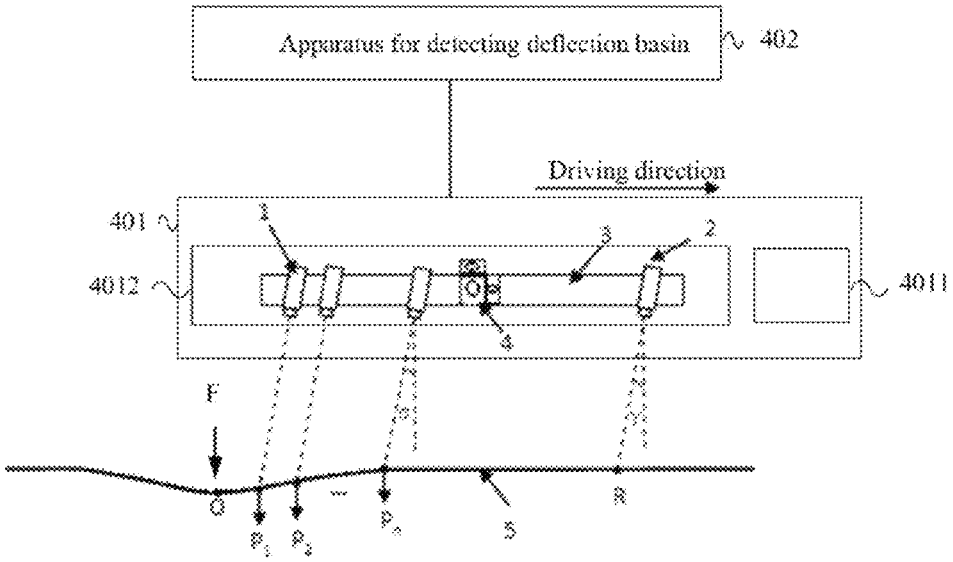
FIG. 4 is a schematic structural diagram of a system for detecting a deflection basin based on deformation velocities of a pavement under a rolling load according to the present application.

FIG. 4 is a schematic structural diagram of a system for detecting a deflection basin based on deformation velocities of a pavement under a rolling load according to the present application. As shown in FIG. 4, the system for detecting a deflection basin includes: a continuous deflection velocity measurement subsystem 401 and an apparatus for detecting a deflection basin 402, where the continuous deflection velocity measurement subsystem 401 includes a towing device 4011 and a carrier 4012;

the carrier 4012 moves, under control of the towing device 4011, on the pavement and applies load to the pavement 5 during the movement; and a crossbeam 3 is provided on the carrier 4012, and a velocity measurement unit, an attitude measurement unit 4 and an auxiliary measurement unit are provided on the crossbeam 3;

where the velocity measurement unit includes a second velocity measurement sensor 2 and at least three first velocity measurement sensors 1 in which each of the first velocity measurement sensors 1 is used to measure the vertical deformation velocities of the pavement in the target deflection basin, the second velocity measurement sensor 2 is installed outside the deflection basin and is used to eliminate the velocity noise included in the measurement of the first velocity measurement sensor in the deflection basin;

the attitude measurement unit 4 is used to measure an attitude angular velocity of the crossbeam; and the auxiliary measurement unit includes a positioning subunit used to obtain a position of the load and a traveling speed of the carrier on the pavement.

Point O in FIG. 4 is the first measurement point, which is the position where the dynamic load F is applied; P1, P2, . . . , Pn are n second measurement points; a represents the installation angle of the first velocity measurement sensor 1; y represents the installation angle of the second velocity measurement sensor 2; and R represents the measurement position corresponding to the second velocity measurement sensor 2.

Finally, it should be noted that: the above embodiments are only used to illustrate the solutions of the present application, rather than limiting them; although the present application has been described in detail with reference to the foregoing embodiments, those skilled in the art should understand that: modifications are made to the solutions described in the foregoing embodiments, or equivalent replacements are made to some of the features; and these modifications or replacements do not make the solutions deviate from the scope of the technical solutions of the various embodiments of the present application.

What is claimed is:

1. A method for detecting a deflection basin based on a deformation velocity of a pavement under a rolling load, comprising:

obtaining vertical deformation velocities of the pavement at respective measurement timings corresponding to respective target locations in a target deflection basin during a load movement;

obtaining durations for respective response time intervals corresponding to the respective target locations based on the respective measurement timings corresponding to the respective target locations, the vertical deformation velocities of the pavement at the respective measurement timings corresponding to the respective target locations and a knowledge base model for the vertical deformation velocities of the pavement;

obtaining representative vertical deformation velocities of the pavement at the respective response time intervals corresponding to the respective target locations based on the vertical deformation velocities of the pavement at the respective measurement timings corresponding to the respective target locations, the durations for respective response time intervals corresponding to the respective target locations, and the knowledge base model for the vertical deformation velocities of the pavement; and obtaining detection results of the target deflection basin based on the representative vertical deformation velocities of the pavement at the respective response time intervals corresponding to the respective target locations and the durations for respective response time intervals corresponding to the respective target locations, wherein the respective target locations comprise a first measurement point and at least three second measurement points, the first measurement point is a location in the target deflection basin where a measurement point corresponding to a central location of a load is located, the second measurement points are locations where measurement points in the target deflection basin except the central location of the load are located;

and each of the respective measurement timings corresponding to respective target locations is calculated from a speed of load movement and a horizontal installation location of a velocimeter in a system for detecting a deflection basin.

2. The method of claim 1, wherein the obtaining detection results of the target deflection basin based on the representative vertical deformation velocities of the pavement at the respective response time intervals corresponding to the respective target locations and the durations for respective response time intervals corresponding to the respective target locations, comprises:

obtaining accumulative vertical deformation amount corresponding to each target location based on the representative vertical deformation velocities of the pavement at respective response time intervals corresponding to each target location and durations for the respective response time intervals; and determining the accumulative vertical deformation amount of each of the respective target locations as a detection result of each target deflection, wherein the obtaining accumulative vertical deformation amount corresponding to each target location based on the representative vertical deformation velocities of the pavement at respective response time intervals corresponding to each target location and durations for the respective response time intervals, comprises:

obtaining each product of representative pavement vertical deformation velocity at each response time interval corresponding to the target location and a duration for each response time interval; and determining a sum of all products as the accumulative vertical deformation amount corresponding to the target location.

3. The method of claim 1, wherein the obtaining representative vertical deformation velocities of the pavement at the respective response time intervals corresponding to the respective target locations based on the vertical deformation velocities of the pavement at the respective measurement timings corresponding to the respective target locations, the durations for respective response time intervals corresponding to the respective target locations, and the knowledge base model for the vertical deformation velocities of the pavement, comprises:

for each target location of the target locations, obtaining representative vertical deformation velocities of the pavement at the respective response time intervals corresponding to the target location based on vertical deformation velocities of the pavement at different measurement timings corresponding to the target location, the durations for respective response time intervals corresponding to the target location, and the knowledge base model for the vertical deformation velocities of the pavement.

4. The method of claim 1, wherein the method is suitable for detecting a deflection basin in highway pavement or airport pavement;

after obtaining the detection results of the target deflection basin based on the representative vertical deformation velocities of the pavement at the respective response time intervals corresponding to the respective target locations and the durations for respective response time intervals corresponding to the respective target locations, the method further comprises:

correcting the detection results of the target deflection basin based on measurement environment information of the target deflection basin and a knowledge base model for correction of deflection basin.

5. The method of claim 4, wherein the detection results of the target deflection basin comprise accumulative vertical deformation amount corresponding to the respective target locations;

the correcting the detection results of the target deflection basin based on measurement environment information of the target deflection basin and a knowledge base model for correction of deflection basin, comprises:

obtaining a correction coefficient for each target location based on the measurement environment information of the target deflection basin and the knowledge base model for correction of deflection basin; and for each target location, correcting the accumulative vertical deformation amount for the target location based on the correction coefficient for each target location.

6. The method of claim 1, wherein the obtaining durations for respective response time intervals corresponding to the respective target locations based on the respective measurement timings corresponding to the respective target locations, the vertical deformation velocities of the pavement at the respective measurement timings corresponding to the respective target locations and the knowledge base model for the vertical deformation velocities of the pavement, comprises:

obtaining respective first durations based on respective measurement timings corresponding to any of the respective target locations, wherein each of the respective first durations is a time difference between two adjacent measurement timings corresponding to any of the target locations;

obtaining a response start time and a response end time of the first measurement point under the load based on the respective first durations, vertical deformation velocities of the pavement at respective measurement timings corresponding to the first measurement point and the knowledge base model for the vertical deformation velocities of the pavement;

obtaining durations for respective response time intervals corresponding to the first measurement point based on respective measurement timings corresponding to the first measurement point and the response start time and the response end time of the first measurement point under the load;

obtaining response start times of the second measurement points under the load based on the respective first durations, vertical deformation velocities of the pavement at respective measurement timings corresponding to the second measurement points and the knowledge base model for the vertical deformation velocities of the pavement; and obtaining durations for respective response time intervals corresponding to the second measurement points based on respective measurement timings corresponding to the second measurement points and the response start times of the second measurement points under the load.

7. The method of claim 6, wherein the obtaining the response start time and the response end time of the first measurement point under the load based on the respective first durations, vertical deformation velocities of the pavement at respective measurement timings corresponding to the first measurement point and the knowledge base model for the vertical deformation velocities of the pavement, comprises:

obtaining the response start time of the first measurement point under the load based on the respective first durations, vertical deformation velocities of the pavement at a plurality of measurement timings corresponding to the first measurement point and being close to the response start time of the first measurement point under the load and the knowledge base model for the vertical deformation velocities of the pavement; and obtaining the response end time of the first measurement point under the load based on the respective first durations, vertical deformation velocities of the pavement at a plurality of measurement timings corresponding to the first measurement point and being close to the response end time of the first measurement point under the load, the knowledge base model for the vertical deformation velocities of the pavement, information on a moving position of the load and movement velocity information of the load.

8. The method of claim 7, wherein the obtaining the response start time of the first measurement point under the load comprises:

obtaining a first rate of change of vertical deformation velocities of the pavement based on the respective first durations and the vertical deformation velocities of the pavement at the plurality of measurement timings corresponding to the first measurement point and being close to the response start time of the first measurement point under the load;

obtaining the response start time of the first measurement point under the load based on the first rate of change and the knowledge base model for the vertical deformation velocities of the pavement, wherein the obtaining response start times of the second measurement points under the load comprises:

obtaining a second rate of change of vertical deformation velocity of the pavement based on the respective first durations and the vertical deformation velocities of the pavement at one or more measurement timings corresponding to each of the second measurement points and being close to the response start time of the second measurement point under the load;

obtaining the response start times of the second measurement points under the load based on the second rate of change and the knowledge base model for the vertical deformation velocities of the pavement, wherein the obtaining the response end time of the first measurement point under the load comprises:

obtaining a first rate of change of vertical deformation velocities of the pavement based on the respective first durations and the vertical deformation velocities of the pavement at the plurality of measurement timings corresponding to the first measurement point and being close to the response end time of the first measurement point under the load; and obtaining the response end time of the first measurement point under the load based on the first rate of change and the knowledge base model for the vertical deformation velocities of the pavement.

9. An apparatus for detecting a deflection basin based on a deformation velocity of a pavement under a rolling load, comprising:

an original velocity obtaining device, used to obtain vertical deformation velocities of the pavement at respective measurement timings corresponding to respective target locations in a target deflection basin during the load movement;

a duration obtaining device, used to obtain durations for respective response time intervals corresponding to the respective target locations based on the respective measurement timings corresponding to the respective target locations, the vertical deformation velocities of the pavement at the respective measurement timings corresponding to the respective target locations and a knowledge base model for the vertical deformation velocities of the pavement;

a representative speed obtaining device, used to obtain representative vertical deformation velocities of the pavement at the respective response time intervals corresponding to the respective target locations based on the vertical deformation velocities of the pavement at the respective measurement timings corresponding to the respective target locations, the durations for respective response time intervals corresponding to the respective target locations, and the knowledge base model for the vertical deformation velocities of the pavement; and a deflection basin detecting device, used to obtain detection results of the target deflection basin based on the representative vertical deformation velocities of the pavement at the respective response time intervals corresponding to the respective target locations and the durations for respective response time intervals corresponding to the respective target locations, wherein the respective target locations include a first measurement point and at least three second measurement points, the first measurement point is a location in the target deflection basin where a measurement point corresponding to a central location of a load is located, the second measurement points are locations where measurement points in the target deflection basin except the central location of the load are located; and each of the respective measurement timings corresponding to respective target locations is calculated from a speed of load movement and a horizontal installation location of a velocimeter in a system for detecting a deflection basin.

10. A system for detecting a deflection basin based on a deformation velocity of a pavement under a rolling load, comprising:

a continuous deflection velocity measurement subsystem, and the apparatus for detecting the deflection basin based on deformation velocity of the pavement under the rolling load of claim 9, wherein the continuous deflection velocity measurement subsystem comprises a towing device and a carrier, the carrier is used to move, under control of the towing device, on the pavement and apply load to the pavement during the movement; and a crossbeam is provided on the carrier, and the crossbeam is provided with a velocity measurement unit, an attitude measurement unit and an auxiliary measurement unit are provided on the crossbeam, the velocity measurement unit comprises a second velocity measurement sensor and at least three first velocity measurement sensors in which each of the first velocity measurement sensors is used to measure the vertical deformation velocities of the pavement in the target deflection basin, the second velocity measurement sensor is installed outside the deflection basin and is used to eliminate velocity noise included in the measurement of the first velocity measurement sensor in the deflection basin;

the attitude measurement unit is used to measure an attitude angular velocity of the crossbeam; and the auxiliary measurement unit comprises a positioning subunit used to obtain a position of the load and a traveling speed of the carrier on the pavement.

* * * * *